US006062638A

United States Patent [19]

Ferguson

[11] Patent Number: 6,062,638

[45] Date of Patent: May 16, 2000

[54] PORTABLE STOOL

[76] Inventor: Bobby J. Ferguson, 5530 N. Estrella, Eloy, Ariz. 85231

[21] Appl. No.: 09/339,327

[22] Filed: Jun. 23, 1999

Related U.S. Application Data

[63] Continuation-in-part of application No. 09/130,016, Aug. 6, 1998, Pat. No. 5,927,797.

[51] Int. Cl.[7] ..... A47C 1/00

[52] U.S. Cl. ..... 297/4

[58] Field of Search ..... 297/4, 313, 337, 297/338, 339, 344.1, 344.12, 344.18; 248/125.8, 161, 157

[56] References Cited

U.S. PATENT DOCUMENTS

| | | |
|---|---|---|
| 226,252 | 4/1880 | Smith et al. . |
| 406,328 | 7/1889 | Yagn . |
| 466,618 | 1/1892 | McDonald . |
| 533,604 | 2/1895 | McHugh . |
| 671,638 | 4/1901 | Slagle . |
| 699,932 | 5/1902 | Smith . |
| 759,809 | 5/1904 | Farley . |
| 1,709,200 | 4/1929 | Westbrook et al. . |
| 2,099,345 | 11/1937 | Olszanowski . |
| 2,935,120 | 5/1960 | Naus . |
| 3,181,828 | 5/1965 | Cramer . |
| 3,306,658 | 2/1967 | Roberts . |
| 4,232,896 | 11/1980 | Caldwell . |
| 4,641,882 | 2/1987 | Young . |
| 4,653,808 | 3/1987 | Opsvik . |
| 4,676,547 | 6/1987 | Spillman . |
| 4,884,842 | 12/1989 | Finkelstein . |
| 4,930,839 | 6/1990 | Saito et al. . |
| 5,720,522 | 2/1998 | Habeck . |

FOREIGN PATENT DOCUMENTS

| | | | |
|---|---|---|---|
| 909494 | 4/1954 | Germany | 297/4 |

*Primary Examiner*—Milton Nelson, Jr.
*Attorney, Agent, or Firm*—John D. Lister

[57] ABSTRACT

A portable stool includes a seat and a single variable length support leg supporting the seat. The support leg can be adjusted to and maintained at a selected length so that the seat is a selected height above the ground, desired by the user, when a normal crouching or seated weight is exerted on the seat by the user. The support leg also includes spring loaded telescoping sections for maintaining a lower end of the support leg in contact with the ground at a selected location when there is an upward or downward movement of the seat from the selected height caused by an upward or downward movement of the user so that the portable stool remains properly positioned beneath the user during such upward and downward movements.

11 Claims, 2 Drawing Sheets

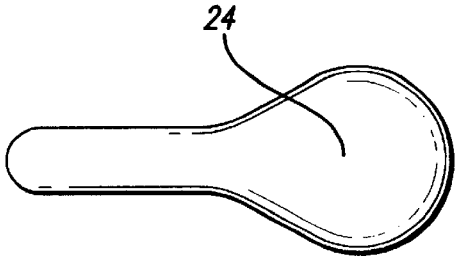
FIG. 3
FIG. 2
FIG. 1
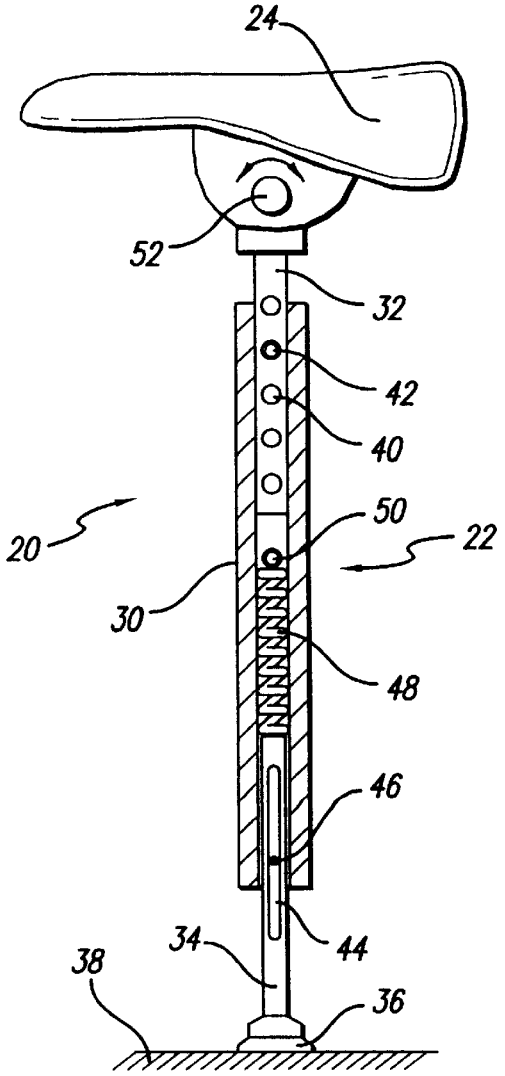
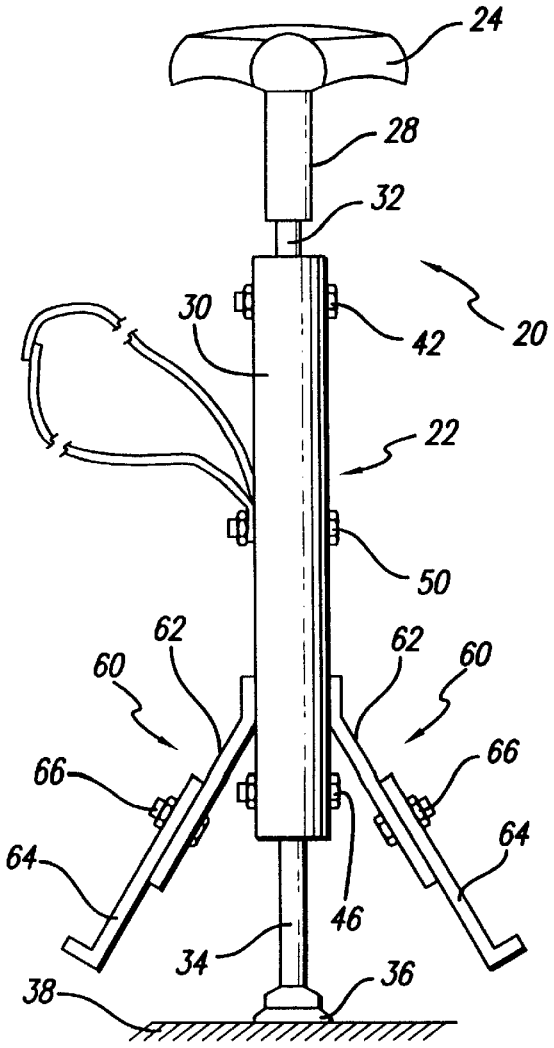

PORTABLE STOOL

This patent application is a continuation-in-part application of patent application Ser. No. 09/130,016; filed Aug. 6, 1998, now U.S. Pat. No. 5,927,797.

BACKGROUND OF THE INVENTION

The present invention relates to a portable stool and, in particular, to a portable stool for use by sportsmen such as fishermen or hunters; spectators such as spectators at a golf match; campers; mechanics; animal groomers; and the like. The portable stool has a single leg that maintains contact with the ground at a selected location while supporting the user even when the user moves or is jostled, e.g. by the recoil of a shotgun, contact with an animal or another person, or other activities associated with the use of the stool. While the portable stool of the present invention is especially suited for uses such as those set forth above, the portable stool is also suitable for other tasks where the user crouches or sits to perform the task. As used herein, the terms "crouch" or "couching" mean a position assumed by a person wherein his/her legs are bent at the knees, but with the front portions of the person's thighs at an angle of less than 90° to the vertical or substantially 90° to the vertical as would be the case if the person were sitting. As used herein, the terms "seated" or "sitting" mean a position assumed by a person wherein his/her legs are bent at the knees with the front portions of the person's thighs at an angle of about 90° to the vertical.

Currently, when hunting, watching an outdoor sporting event such as golf, working on a vehicle, grooming an animal, or performing other, mostly, outdoor activities, a person typically stands or crouches with no support. The need to stand or crouch in one place for an extended period of time to watch an event, to hunt or fish, or to perform some other activity can create a great deal of stress and strain on a person's lower back and legs. The stress and strain placed on the person's lower back and legs while standing or crouching to watch an event, hunt, fish or perform some other activity reduces the amount of time the person can enjoyably spend watching the event or performing the activity and may prevent some individuals, with physical impairments such as lower back and leg problems, from participating in such activities.

Portable stools have been made in the past in an attempt to resolve the above and other problems. Examples of such attempts are disclosed in the following patents. U.S. Pat. No. 226,252, issued Apr. 6, 1880 discloses an adjustable stool which is strapped to the operator. U.S. Pat. No. 406,328, issued Jul. 2, 1889, discloses an apparatus to facilitate walking and running that includes a separate saddle "A" secured to each buttock; a separate support standard "C" for each buttock; and a shoe "E" for each standard that attaches the apparatus to the person's lower extremities. U.S. Pat. No. 466,618, issued Jan. 5, 1892, discloses a combined horseshoer's stool and clincher. U.S. Pat. No. 533,604, issued Feb. 5, 1895, discloses a farrier's shoe stand. U.S. Pat. No. 671,638, issued Apr. 9, 1901, discloses a stool and cane that is strapped to the user. U.S. Pat. No. 699,932, issued May 13, 1902, discloses a portable seat which is strapped to the user. U.S. Pat. No. 759,809, issued May 10, 1904 discloses a cotton, berry or vegetable picking or dairy stool which is strapped to the user. U.S. Pat. No. 1,709,200, issued Apr. 16, 1929, discloses a sanitary milking rest which is strapped to the user and has a pointed lower end that engages the floor or ground to keep the rest from moving. U.S. Pat. No. 2,099,345, issued Nov. 16, 1937, discloses a body support or stool that is strapped to the user. U.S. Pat. No. 4,232,896, issued Nov. 11, 1980, discloses a portable and collapsible seat that can be secured to the waist of a person. U.S. Pat. No. 4,641,882, issued Feb. 10, 1987, discloses an orthopedic appliance with a seat that can be clipped to a person's ankle. While the stools and other devices disclosed in the above patents are useful, none of the stools or other devices disclosed provide: a) a means for maintaining the lower end of the support leg of a stool properly positioned beneath the user and in contact with the ground to provide support for the user in the event the user is raised up or moved e.g. by the recoil of a shotgun, by a horse or other animal, by being jostled, or raises up of his/her own accord to reach for something or for some other reason; and b) a means for permitting the seat of the stool to move downward in the event the user is forced down, e.g. by contact with an animal be groomed or shoed or contact with another person.

SUMMARY OF THE INVENTION

The present invention provides a solution to the above problem by providing a unique portable stool for supporting the user while watching an event or performing an activity. THe portable stool of the present invention allows the user to: a) be supported in a crouch or sitting position to watch an event or perform an activity; b) have his/her hands free while watching an event or performing an activity; c) move or be moved while watching an event or performing an activity, such as adjusting his/her sitting position, rising up or being raised up or jostled by contact with another person or animal; and d) easily carry the stool from place to place.

In a preferred embodiment of the portable stool of the present invention, the portable stool includes a telescoping support leg, a seat mounted on the support leg, and a strap (e.g. a shoulder strap) secured to the support leg or seat for carrying the stool from place to place. The telescoping support leg in the preferred embodiment has a spring loaded lower or upper extension or section which slides up and down with respect to a midsection of the support leg. When the user, e.g. a spectator, hunter, mechanic, farrier, is crouching or sitting on the portable stool and using the portable stool for support, the spring loaded lower or upper extension or section: a) maintains the lower end of the telescoping support leg in contact with the ground and properly positioned beneath the user to support the user even when the user rises up or is raised up; and b) permits the seat of stool to move downward, with the lower end of the support leg remaining in place, when the user places more weight on the portable stool or is forced down. Thus, the portable stool of the present invention, provides the support required to alleviate stress and strain on the lower back and legs of spectators, hunters, campers, animal groomers, farriers, mechanics and other users or workers who need to have their hands free and may have to move or may be moved while crouching or sitting on the stool for support.

Preferably, the seat of the portable stool is narrow which enables the a user to better grip objects between his/her legs to work on the object; the length of the telescoping support leg is adjustable to set the seat height at a comfortable level for the user when crouching or sitting; and a pair of stabilizing legs can be secured to the telescoping support leg to prevent the portable stool from tipping sideways.

BRIEF DESCRIPTION OF THE DRAWINGS

FIG. 1 is a side elevation of a first embodiment of the portable stool of the present invention with the lower spring loaded section or extension of the telescoping support leg only partially extended from the midsection of the support leg.

FIG. 2 is a front elevation of the portable stool of FIG. 1 with the lower spring loaded section or extension of the support leg partially extended from the midsection of the support leg and a strap for carrying the portable stool attached to the support leg.

FIG. 3 is a top view of the seat of the portable stool of FIG. 1.

DESCRIPTION OF THE PREFERRED EMBODIMENTS

Figure 5:
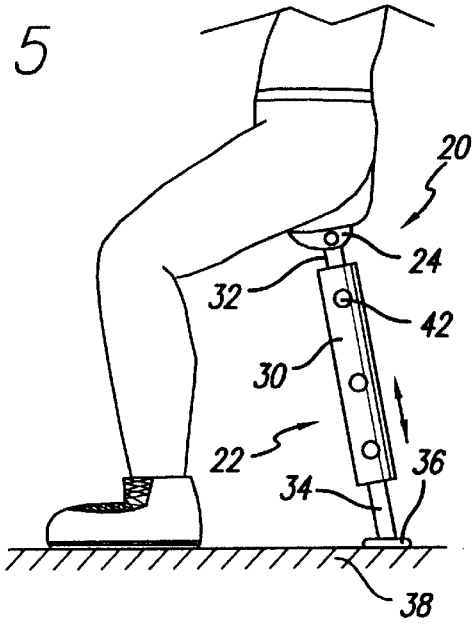
FIG. 5 is a schematic representation of a person in a crouch, such as when watching a sporting event, and using the portable stool of the present invention as a support.

FIGS. 1–3 show a first embodiment 20 of the portable stool of the present invention which includes a variable length, telescoping support leg 22, a seat 24 mounted on the support leg, and straps 26 secured to the telescoping support leg for carrying the portable stool 20. In use the seat 24 is located between the legs of the user at the user's crotch with the buttocks of the user resting on the seat and the lower end of the support leg 22 is placed in contact with the ground at the proper location for supporting the user on the seat. Preferably, the tubular and cylindrical components of the telescoping support leg are made of a metal, such as steel, or a polymeric or reinforced polymeric material.

When the portable stool is used for tasks such as horse shoeing, the length of the portable stool from the upper surface of the seat 24 to the lower end 36 of the portable stool, with the telescoping support leg fully extended, can typically be adjusted from about twenty nine to about thirty six inches. For performing other tasks where the user would normally be in more of a sitting position or a sitting position rather than crouching, the maximum and minimum length of the portable stool, over which it can be adjusted, will typically be less, such as but not limited to about twenty to about twenty six inches. As will be discussed more fully hereinafter, when the user places his/her weight on the portable stool 20 for support, the spring loaded extension or section of the telescoping support leg will be depressed within the midsection of the telescoping leg 22 and the overall length of the portable stool will typically shorten by two to five inches.

As shown in FIGS. 1 and 2, telescoping support leg 22 of the portable stool 20 includes a midsection 30, an upper section or extension 32 on which the seat 24 is mounted, and a lower spring loaded section or extension 34 for keeping the lower end 36 of the telescoping support leg 22 in contact with the ground or floor 38 when there is upward and/or downward movement of the user while crouching or seated on the portable stool. The transverse dimensions of the lower end 36 of the telescoping support leg typically range from about 1½ inches to about 6 inches. Larger transverse dimensions are generally used on the lower end 36 of the telescoping support leg to increase its surface area and prevent the lower end of the telescoping support leg from sinking into the ground when in use.

As best shown in FIG. 1, the upper section 32 is slidably received within an upper portion of the midsection 30 of the telescoping support leg 22 and has a series of horizontally extending holes 40 therein for receiving a pin or bolt 42 that passes through both the upper portion of the midsection 30 and one of the holes 40 in the upper section 32 to set the height of the seat 24 above the ground 38 to a selected height desired by the user for crouching or sitting on the portable stool 20. As discussed above, when used for horse shoeing, preferably, the upper section 32 enables the height of the seat to be adjusted in increments of about one inch for about six inches with the overall height of the portable stool 20, with the lower section or extension 34 fully extended, preferably being between about twenty nine and about thirty six inches.

The lower section or extension 34 is slidably received within a lower portion of the midsection 30 of the telescoping support leg 22 and has an elongated slot 44 (preferably, from about three inches to about nine inches long and most preferably from about four to about seven inches long) therein for receiving a pin or bolt 46 that passes through both the lower portion of the midsection 30 and the lower section or extension 34. As shown a coil spring 48 is located within the midsection 30 intermediate a pin, bolt or other means 50 to block the upward movement of the coil spring 48 and the upper end of the lower section or extension 34. In an unweighted condition (when no one is crouching or sitting on the portable stool 20 for support), the coil spring 48 forces or urges the lower section or extension 34 of the telescoping support leg 22 to a fully extended position wherein the pin or bolt 46 passing through the both the lower portion of the midsection 30 and the lower section or extension 34 abuts the upper end of the elongated slot 44. In a normal weighted condition (when the user, e.g. a spectator, hunter or farrier, is crouching or sitting on the portable stool at rest for support) the lower section or extension 34 will only be partially extended in a position such as that shown in FIGS. 1, 2 and 5, where the location of the pin or bolt 46, relative to the elongated slot 44, is intermediate the upper and lower ends of the slot and preferably about one third or less of the length of the slot (e.g. two inches or less) from the lower end of the elongated slot 44. In a fully weighted condition, such as when the user is forced downward by the movement of horse, the downward force of the coil spring 48 on the upper end of the lower section or extension 34 of the telescoping support leg 22 or the contact of the pin or bolt 46 passing through the both the lower portion of the midsection 30 and the elongated slot 44 in lower section or extension 34 with the lower end of the elongated slot 44 limits the downward movement of the portable stool 20 from its normal weighted position.

For most applications, the coil spring 48 is selected to support the weight of an adult, e.g. a person weighing between about 105 and 245 pounds, so that the force from the weight of the person crouching or seated at rest on the seat 24 will preferably compress the spring 48, from an uncompressed length of about four to about ten inches to a partially compressed length of between about two inches and about seven inches, and thus move the lower section or extension 34 axially up into the midsection 30 a distance of about two inches to about eight inches. While three inches of vertical movement in the telescoping support leg 22 has been found sufficient to keep the lower end 36 of the telescoping support leg in contact with the ground or floor 38 for many vertical movements experienced when the portable stool 20 is being used by a farrier for shoeing horses, the preferred range of four to seven inches assures that the lower end 36 of the telescoping support leg 22 remains in contact with the ground for all but the most excessive movements of the person crouching or seated on the portable stool. While the elongated slot 44 can be longer than nine inches and the spring longer than ten inches, for practical purposes nine inches of vertical movement is sufficient. For example, when the portable stool is used by a farrier, if the horse is moving the farrier vertically more than nine inches, the horse is most likely out of control and the farrier had better move away from the horse. Preferably, the weight of the person crouching or sitting at rest on the seat 24 will not fully compress the coil spring 48 so that downward movement of the portable stool will be resisted by further compression of the spring 48 to cushion the user should the user be forced downward, e.g by the movement of a horse, contact with another person, or the recoil of a shotgun.

Preferably, the seat 24 of the portable stool 20 is a narrow seat, such as a narrow bicycle seat, which is secured to the upper end of the upper section 32 of the telescoping support leg 22 by a bolt mount 52 that permits the seat 24 to be adjusted about a horizontal axis, such as a conventional mount used to secure a bicycle seat to an upstanding support shaft mounted in a bicycle frame.

The portable stool 20 may be provided with a pair of straps 26 or 126 secured to either the telescoping support leg (FIG. 2) or the back of the seat (FIG. 4) for carrying the portable stool. The straps 26 or 126 form an adjustable carrying loop or shoulder strap and may be secured to the portable stool 20 either permanently or with a conventional quick connect/disconnect coupling. The straps 26 or 126 can be provided with a hook and loop or hook and pile securement, such as Velcro™, a belt buckle, or other conventional means for securing the ends of the straps together to form the carrying loop or shoulder strap.

As shown in FIG. 2, the portable stool 20 can also be provided with a pair of side stabilizers 60 to prevent the portable stool from tipping to far over sideways. The side stabilizers 60 extend diagonally out from each side of the telescoping support leg 22 and, as shown, can be welded or otherwise permanently secured to the sides of the midsection 30 of the telescoping support leg 22. As shown, each of the side stabilizers includes upper and lower sections 62 and 64 which are bolted together. Either or both of the sections have an elongated slot therein through which the bolt 66 passes so that the length of the side stabilizers can be adjusted to a selected length so that preferably, the side stabilizers are not in contact with the ground when the user is crouching or sitting on the portable stool at rest (a normal weighted condition). While not shown, the upper ends of the side stabilizers can be bolted to the sides of the midsection 30, e.g. with the bolt 50, so that the side stabilizers can be removed from the portable stool if desired. In addition, when bolted to the midsection by bolt 50, the upper ends of the side stabilizers 60 could be elongated and slotted to permit vertical adjustment of the side stabilizers rather than making the adjustment by having upper and lower sections 62 and 64 bolted together and the side stabilizers could each be made of one piece.

Figure 4:
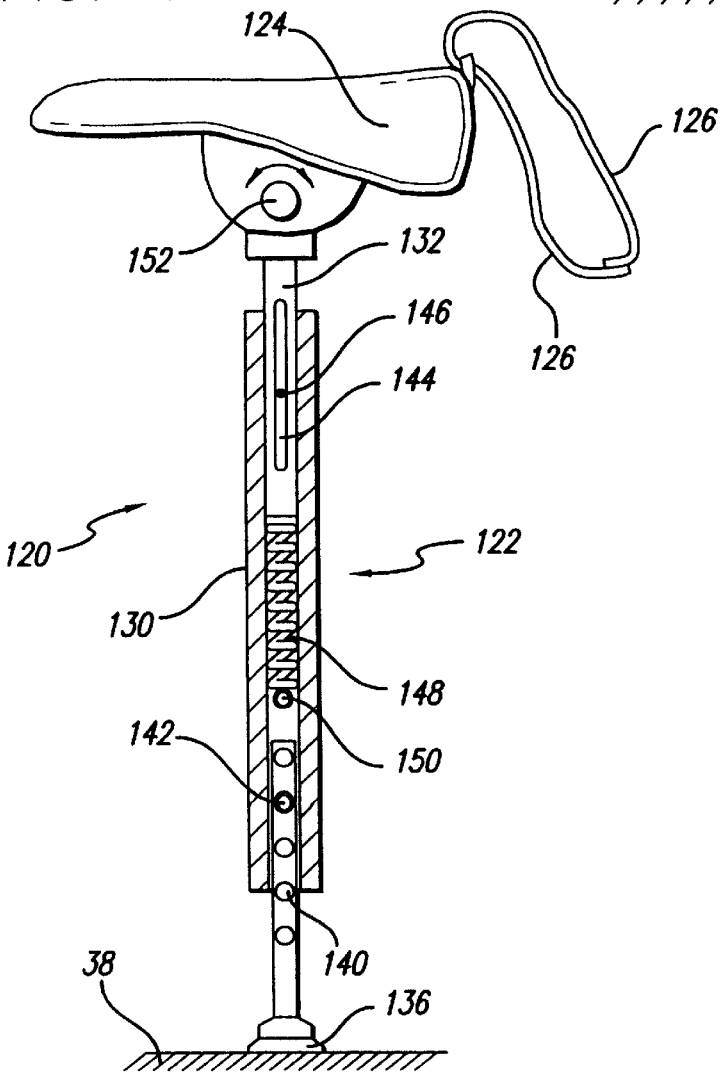
FIG. 4 is a side elevation of a second embodiment of the portable stool of the present invention with the upper spring loaded section or extension of the telescoping support leg only partially extended from the midsection of the support leg and a strap for carrying the portable stool attached to the seat.

FIG. 4 shows a second embodiment 120 of the portable stool of the present invention which includes a telescoping support leg 122, a seat 124 mounted on the support leg, and straps 26 secured to the back of the seat 124 for carrying the portable stool 20. The transverse dimensions of the lower end 136 of the telescoping support leg typically range from about 1½ inches to about 6 inches. Larger transverse dimensions are generally used on the lower end 136 of the telescoping support leg to increase its surface area and prevent the lower end of the telescoping support leg from sinking into the ground when in use.

As shown in FIGS. 4, telescoping support leg 122 of the portable stool 120 includes a midsection 130, an upper spring loaded section 132 to which the seat 124 is mounted, and a lower section or extension 134. The upper spring loaded section 132 keeps the lower end 136 of the telescoping support leg 122 in contact with the ground or floor 38 when there is upward and/or downward movement of the user while crouching or seated on the portable stool. The upper section 132 is slidably received within an upper portion of the midsection 130 of the telescoping support leg 122 and has an elongated slot 144 (preferably, from about three inches to about nine inches long and most preferably from about four to about seven inches long) therein for receiving a pin or bolt 146 that passes through both the upper portion of the midsection 130 and the upper section or extension 132. As shown a coil spring 148 is located within the midsection 30 intermediate a pin, bolt or other means 150 to block the downward movement of the coil spring 148 and the lower end of the upper section or extension 132. In an unweighted condition (when no one is crouching or sitting on the portable stool 120), the coil spring 148 forces or urges the upper section or extension 132 of the telescoping support leg 122 to a fully extended position wherein the pin or bolt 146 passing through the both the upper portion of the midsection 130 and the upper section or extension 132 abuts the lower end of the elongated slot 144. In normal weighted condition, when the user, e.g. a spectator, hunter or farrier, is crouching or sitting on the portable stool at rest, the upper section or extension 132 will only be partially extended in a position such as that shown in FIG. 4, where the location of the pin or bolt 146, relative to the elongated slot 144, is intermediate the upper and lower ends of the slot and preferably about one third or less of the length of the slot (e.g. two inches or less) from the upper end of the elongated slot 144. In a fully weighted condition, the upward force of the coil spring 148 on the lower end of the upper section or extension 132 of the telescoping support leg 122 or the contact of the pin or bolt 146 passing through the both the upper portion of the midsection 130 and the elongated slot 144 in upper section or extension 132 with the upper end of the elongated slot 144 limits the downward movement of the portable stool 120.

For most applications, the coil spring 148 is selected to support the weight of an adult, e.g. a person weighing between about 105 and 245 pounds, so that the force from the weight of the person crouching or seated at rest on the seat 124 will preferably compress the spring 148, from an uncompressed length of about four to about ten inches to a partially compressed length of between about two inches and about seven inches, and thus move the upper section or extension 132 axially down into the midsection 130 a distance of about two inches to about eight inches. While three inches of vertical movement has been found sufficient to keep the lower end 136 of the telescoping support leg in contact with the ground or floor 38 for many vertical movements experienced when the portable stool 120 is being used by a farrier for shoeing horses, the preferred range of four to seven inches assures that the lower end 136 of the telescoping support leg 122 remains in contact with the ground for all but the most excessive movements of the user. While the elongated slot 144 can be longer than nine inches and the spring 148 longer than ten inches, for practical purposes nine inches of vertical movement is sufficient. For example, when the stool is used by a farrier, if the horse is moving the farrier vertically for more than nine inches, the horse is most likely out of control and the farrier had better move away from the horse. Preferably, the weight of the person crouching or sitting at rest on the seat 124 will not fully compress the coil spring 148 so that downward movement of the portable stool will be resisted by further compression of the spring 148 to cushion the user should the user be forced downward, e.g by the movement of a horse, contact with another person, or the recoil of a shotgun.

The lower section or extension 134 is slidably received within a lower portion of the midsection 130 of the telescoping support leg 122 and has a series of horizontally extending holes 140 therein for receiving a pin or bolt 142 that passes through both the lower portion of the midsection 130 and one of the holes 140 in the lower section 132 to set the height of the seat 124 above the ground 138 to a selected height desired by the user for crouching or sitting on the portable stool 120. Preferably, the lower section 134 enables the height of the seat to be adjusted in increments of about one inch for about six inches. When used for horse shoeing, preferably, the overall height of the portable stool 120 with the upper section or extension 132 fully extended, is between about twenty nine and about thirty six inches.

As with the first embodiment, preferably, the seat 124 of the portable work stool 120 is a narrow seat, such as a narrow bicycle seat, which is secured to the upper end of the upper section 132 of the telescoping support leg 122 by a bolt mount 152 that permits the seat 124 to be adjusted about a horizontal axis, such as a conventional mount used to secure a bicycle seat to the upstanding support shaft mounted in the bicycle frame.

The portable stool 120 may be provided with a pair of straps 26 or 126 secured to either the telescoping support leg (FIG. 2) or the back of the seat (FIG. 4) for carrying the portable stool. The straps 26 or 126 form an adjustable carrying loop or shoulder strap and may be secured to the portable stool 20 either permanently or with a conventional quick connect/disconnect coupling. The straps 26 or 126 can be provided with a hook and loop or hook and pile securement means, such as Velcro™, a belt buckle, or other conventional means for securing the ends of the straps together to form the carrying loop or shoulder strap.

While not shown, the portable stool 120 can also be provided with side stabilizers such as the side stabilizers shown in FIG. 2 and described above in connection with the portable stool 20.

In use a person desiring to use the portable stool 20 or 120 crouches or sits on the seat 24 or 124 of the portable stool at rest (a normal weighted condition for that user). If the portable stool is not at the height desired for the user, the person adjusts the height of the portable stool by adjusting the upper section or extension 32 in the portable stool 20 or by adjusting the lower section or extension 134 in the portable stool 120. Once the height of the portable stool is adjusted to the selected height, the user adjusts the angle of seat for his/her comfort. The user then: selects the proper location on the ground or floor 38 to place the lower end 36 or 136 of the telescoping support leg 22 or 122 to give the user the required support; places the lower end of the telescoping support leg 22 or 122 at that location; crouches (as shown in FIG. 5) or sits on the portable stool 20 or 120; and commences his/her activity crouching or seated at his/her desired height for the activity. If the activity, such as horse shoeing, causes upward and downward movement of the user relative to the set or normal height of the portable stool, such as when a horse moves, for upward movement, the spring loaded lower or upper extension keeps the lower end 36 or 136 of the telescoping support leg 22 or 122 in contact with the ground or floor 38 at the selected location to maintain support for the user and, for downward movement, the spring loaded upper or lower extension cushions the downward movement of the portable stool for the comfort of the user. Any time the user needs to move to a new location, the user merely stands up and grips the straps 26, 126 or places the straps 26, 126 over his/her shoulder and goes about his/her activities with the portable stool over his/her shoulder or carried by hand and ready to be located on the ground or floor at a new location the next time the user crouches or sits down.

While the embodiments shown have upper and lower cylindrical extensions or sections of the telescoping support leg received within a tubular midsection, the upper and lower extensions or section can be tubular and the midsection can be a solid cylindrical midsection. Preferably, a conventional coil spring or its equivalent, such as a hydraulic or pneumatic cylinder with a coil spring or other biasing means, is used to extend the upper or lower section of the portable stool.

A third stabilizer arm (not shown) could also be placed at the rear of the portable stool. However, since the telescoping support leg 22 of the portable stool is typically inclined forward from the ground or floor at an angle when located beneath the user for support, e.g. as shown in FIG. 5, the length of a third stabilizer arm, required to prevent backward tilting movement of the portable stool might interfere with the placement of the portable stool in confined quarters or otherwise present problems when the user is up and moving around.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A portable stool, comprising:

a seat means for supporting a person in a crouching or sitting position when the seat means is positioned at the person's crotch with the person's buttocks resting on the seat means;

only a single telescoping support leg means for supporting the seat means; the support leg means including means at an upper end of the support leg means securing the support leg means to the seat means; the support leg means having a variable length; the support leg means having means for adjusting the length of the support leg means to a selected length, under a normal weighted condition when the person is crouching or seated at rest on the seat means, to thereby adjust the seat means to a selected height above the ground desired by the person; and the support leg means having a lower end free of attachment to the person's lower extremities; the support leg means having first and second telescoping sections and a spring means, which is only partially compressed under the normal weighted condition, for maintaining the seat means at the selected height under the normal weighted condition, for urging the second section axially away from the first section to elongate the support lea means from the selected length when there is less than the normal weighted condition caused by upward movement of the person, and for allowing the second section to move axially into the first section to shorten the support leg means from the selected length when there is more than the normally weighted condition caused by downward movement of the person so that the portable stool remains properly positioned beneath the person during such upward movements and cushions the person during such downward movements.

2. The portable work stool according to claim 1, wherein:

the first and second telescoping sections have a range of axial movement relative to each other that is from about three to about nine inches.

3. The portable work stool according to claim 1, wherein:

the first and second telescoping sections have a range of axial movement relative to each other that is from about four to about seven inches.

4. The portable stool according to claim 1, wherein:

the first and second telescoping sections of the support leg means are located in a lower portion of the support leg means.

5. The portable stool according to claim 1, wherein:

the first and second telescoping sections of the support leg means are located in an upper portion of the support leg means.

6. The portable stool according to claim 5, including:

side stabilizer means secured to the support leg means for limiting sideward tilting movement of the portable work stool.

7. The portable stool according to claim 1, including strap means for carrying the portable stool when the portable stool is not in use.

8. The portable stool according to claim 7, wherein: the strap means for carrying the portable stool is a shoulder strap means secured to the seat means.

9. The portable stool according to claim 7, wherein: the strap means for carrying the portable stool is a shoulder strap means secured to the support leg means.

10. The portable stool according to claim 1, including: side stabilizer means secured to the support leg means for limiting sideward tilting movement of the portable work stool.

11. The portable stool according to claim 10, wherein: the side stabilizer means includes two stabilizer arms secured to and projecting outwardly and downwardly from opposite sides of the support leg means; the two stabilizer arms having lower ends for contacting the ground when there is sideward tilting movement of the portable stool; and means for vertically adjusting and positioning the lower ends of the two stabilizer arms relative to the support leg means.

* * * * *